US006659834B2

(12) United States Patent
Thai

(10) Patent No.: US 6,659,834 B2
(45) Date of Patent: Dec. 9, 2003

(54) APPARATUS AND METHOD FOR DELIVERING BUBBLE SOLUTION TO A DIPPING CONTAINER

(75) Inventor: Douglas Thai, Walnut, CA (US)

(73) Assignee: Arko Development Limited, Hong Kong (HK)

( * ) Notice: Subject to any disclaimer, the term of this patent is extended or adjusted under 35 U.S.C. 154(b) by 0 days.

(21) Appl. No.: 10/099,431

(22) Filed: Mar. 15, 2002

(65) Prior Publication Data

US 2003/0176141 A1 Sep. 18, 2003

(51) Int. Cl.[7] ..... A63H 3/00
(52) U.S. Cl. ..... 446/74; 446/16
(58) Field of Search ..... 446/74, 180, 183, 446/16–21; 222/212, 206; 239/327

(56) References Cited

U.S. PATENT DOCUMENTS

| | | | | | |
|---|---|---|---|---|---|
| 2,560,582 | A | | 7/1951 | Limber | |
| 2,659,177 | A | | 11/1953 | Kopf | |
| 2,974,438 | A | | 3/1961 | Hopkins | |
| 3,420,412 | A | * | 1/1969 | Greene | |
| 3,579,898 | A | | 5/1971 | Hein | |
| 3,604,144 | A | | 9/1971 | Span | |
| 4,423,565 | A | * | 1/1984 | Bart | |
| 4,700,965 | A | | 10/1987 | Kinberg | |
| 4,804,346 | A | * | 2/1989 | Sheng | 446/17 |
| 4,861,303 | A | * | 8/1989 | Mong-Sheng | 446/17 |
| 4,957,464 | A | | 9/1990 | Perez | |
| 4,988,319 | A | * | 1/1991 | Shen | 446/19 |
| 5,230,648 | A | * | 7/1993 | Kelley et al. | 446/74 |
| 5,395,274 | A | | 3/1995 | Myers | |
| 5,498,191 | A | * | 3/1996 | DeMars | 446/15 |
| 5,542,869 | A | | 8/1996 | Petty | |
| 5,613,890 | A | | 3/1997 | DeMars | |
| 5,850,945 | A | * | 12/1998 | Frankel | 222/212 |
| 5,879,218 | A | | 3/1999 | Tao | |
| 6,062,935 | A | | 5/2000 | Gross | |
| 6,149,486 | A | | 11/2000 | Thai | |
| 6,200,184 | B1 | | 3/2001 | Rich et al. | |
| 6,331,130 | B1 | | 12/2001 | Thai | |
| 6,343,712 | B1 | * | 2/2002 | Flackett et al. | 222/78 |

FOREIGN PATENT DOCUMENTS

| | | | |
|---|---|---|---|
| GB | 2224950 | * | 5/1990 |

* cited by examiner

*Primary Examiner*—Jacob K. Ackun
*Assistant Examiner*—Jamila Williams
(74) *Attorney, Agent, or Firm*—Raymond Sun

(57) ABSTRACT

An apparatus and method of delivering bubble solution to a bubble solution dipping container includes a bubble solution dipping container having a wall that defines a chamber. The apparatus also has a bottle having a wall that defines an interior that contains bubble solution. The bottle is releasably connected to the container, and a supply tube is provided to establish a fluid connection between the interior of the bottle and the chamber of the dipping container. The user can then apply pressure to the wall of the bottle to deliver the bubble solution from the interior of the bottle to the chamber of the container.

16 Claims, 4 Drawing Sheets

APPARATUS AND METHOD FOR DELIVERING BUBBLE SOLUTION TO A DIPPING CONTAINER

BACKGROUND OF THE INVENTION

1. Field of the Invention

The present invention relates to bubble toys, and in particular, to an apparatus and method for delivering bubble solution to a dipping container.

2. Description of the Prior Art

Bubble producing toys are very popular among children who enjoy producing bubbles of different shapes and sizes. Many bubble producing toys have previously been provided. Perhaps the simplest example has a stick with a circular opening or ring at one end, resembling a wand. A film is produced when the ring is dipped into a dish that holds bubble solution or bubble producing fluid (such as soap) and then removed therefrom. Bubbles are then formed by blowing carefully against the film. Such a toy requires dipping every time a bubble is to created, and the bubble solution must accompany the wand from one location to another.

Recently, the market has provided a number of different bubble generating assemblies that are capable of producing a plurality of bubbles. Examples of such assemblies are illustrated in U.S. Pat. No. 6,149,486 (Thai), U.S. Pat. No. 6,331,130 (Thai) and U.S. Pat. No. 6,200,184 (Rich et al.). The bubble rings in the bubble generating assemblies in U.S. Pat. No. 6,149,486 (Thai), U.S. Pat. No. 6,331,130 (Thai) and U.S. Pat. No. 6,200,184 (Rich et al.) need to be dipped into a dish that holds bubble solution to produce films of bubble solution across the rings. The motors in these assemblies are then actuated to generate air against the films to produce bubbles.

All of these aforementioned bubble generating assemblies require that one or more bubble rings be dipped into a dish of bubble solution. In particular, the child must initially pour bubble solution into the dish, then replenish the solution in the dish as the solution is being used up. After play has been completed, the child must then pour the remaining solution from the dish back into the original bubble solution container. Unfortunately, this continuous pouring and re-pouring of bubble solution from the bottle to the dish, and from the dish back to the bottle, often results in unintended spillage, which can be messy, dirty, and a waste of bubble solution.

Another bubble generating assembly is illustrated in U.S. Pat. No. 5,613,890 (DeMars). DeMars uses a battery-operated machine to control a wiper bar to apply bubble solution onto a bubble ring. Although such a design avoids some of the spillage problems described above, the construction of the bubble generating assembly in DeMars is quite complex, which increases the overall cost of the bubble generating assembly. More importantly, the complex construction has many different moving and interengaging parts that increase the likelihood of defects. Sadly, any defect with any part could mean that the entire assembly is not operational. In addition, DeMars uses a single motor which powers two operations: (1) to pump the bubble solution to the wiper bar, and (2) to cause the fan to blow air at the bubble ring. Depending on the size and quality of the motor, the single motor may not be able to simultaneously perform both tasks effectively, which may negatively affect the quality of the bubbles produced by the bubble generating assembly.

Thus, there remains a need to provide an apparatus and method for delivering bubble solution to a dish or other similar dipping container while avoiding the problems described above.

SUMMARY OF THE DISCLOSURE

It is an object of the present invention to provide an apparatus and method for delivering bubble solution to a dipping container.

It is another object of the present invention to provide an apparatus and method for delivering bubble solution to a dipping container in a manner which minimizes spillage of the bubble solution.

It is yet another object of the present invention to provide an apparatus having a simple construction that delivers bubble solution to a dipping container.

The objectives of the present invention are accomplished by providing an apparatus and method of delivering bubble solution to a bubble solution dipping container. The apparatus has a bubble solution dipping container having a wall that defines a chamber. The apparatus also has a bottle having a wall that defines an interior that contains bubble solution. The bottle is releasably connected to the container, and a supply tube is provided to establish a fluid connection between the interior of the bottle and the chamber of the dipping container. The user can then apply pressure to the wall of the bottle to deliver the bubble solution from the interior of the bottle to the chamber of the container.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

The present invention provides an apparatus that includes a dipping container and a conventional bubble solution bottle. The bottle is removably secured to the dipping container. A tube is secured to the dipping container and fluidly communicates between the interior of the bottle and the interior of the dipping container. With the bottle secured to the dipping container, the user can press the wall of the bottle to create a pressure that pushes bubble solution from the bottle through the tube and into the dipping container. The dipping container also has an outlet that communicates with the interior of the bottle. The outlet can be opened and closed at the discretion of the user to allow the unused bubble solution in the dipping container to flow back into the bottle.

Figure 1:
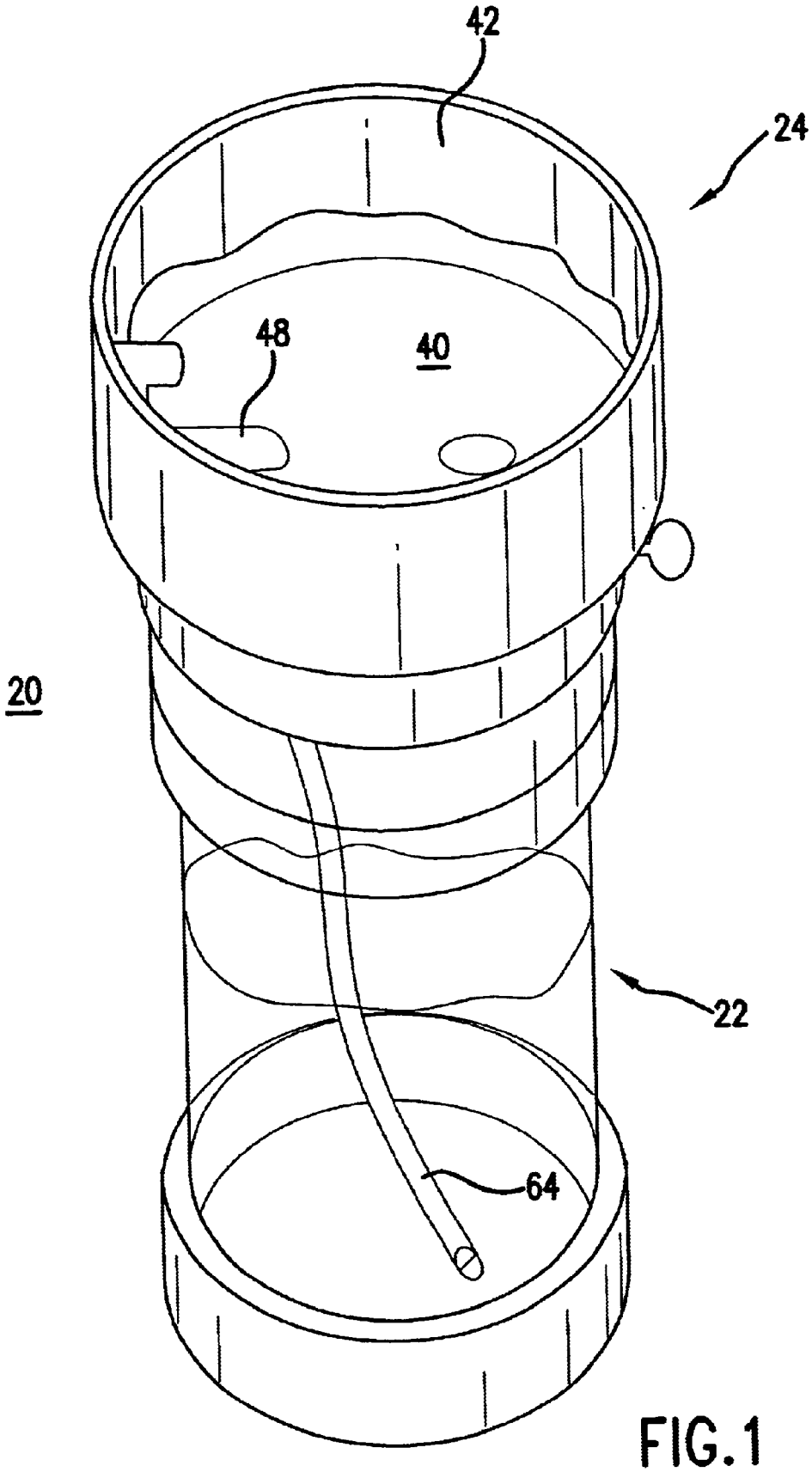
FIG. 1 is a top perspective view of an apparatus that delivers bubble solution to a dipping container according to one embodiment of the present invention.
Figure 2:
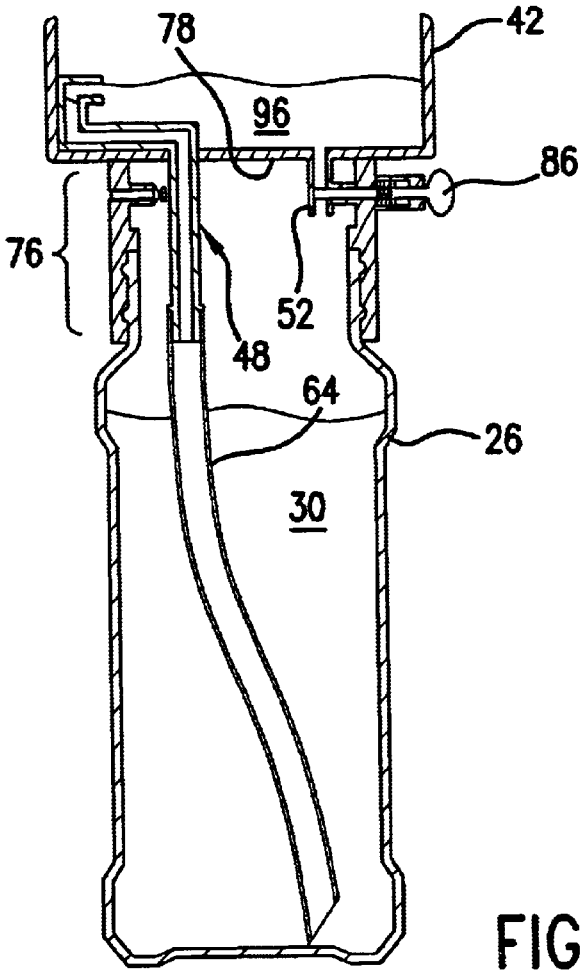
FIG. 2 is a cross-sectional view of the apparatus of FIG. 1.
Figure 3:
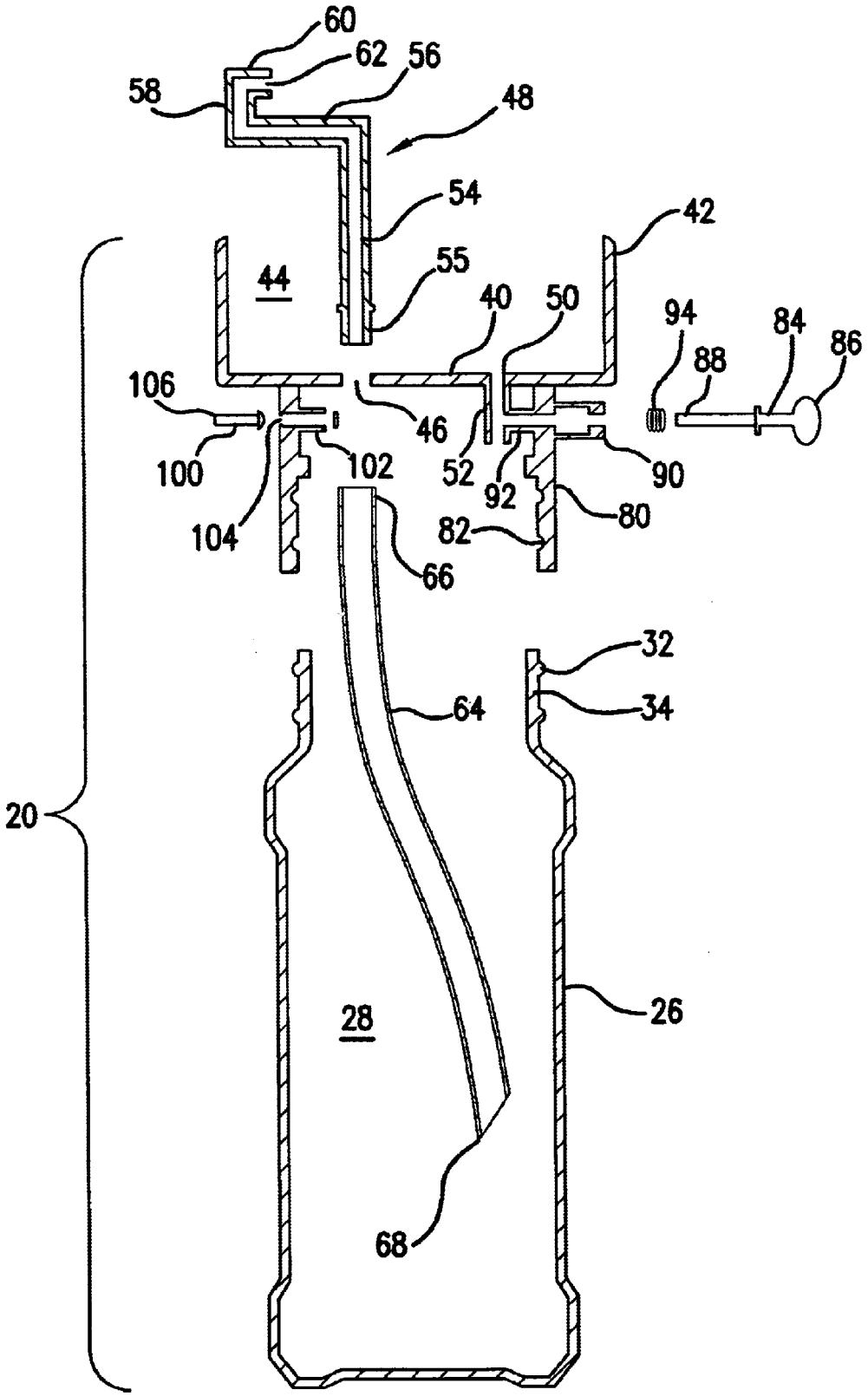
FIG. 3 is an exploded cross-sectional view of the apparatus of FIG. 1.

FIGS. 1–3 illustrate one embodiment of an apparatus 20 according to the present invention. The apparatus has a bubble solution bottle 22 that is removably attached to a dipping container 24. The bottle 22 can take the form of any conventional bubble solution bottle that is commonly available in the marketplace, with one non-limiting example being the bubble solution bottles marketed under the trademarks TOOTSIETOY™ and MR. BUBBLES™ by Strombecker Corp. The bottle 22 has a generally cylindrical wall 26 which is typically made of a soft plastic material that is squeezable by the user. The interior 28 of these bubble solution bottles 22 is typically filled with bubble solution 30, and a cap or lid (not shown) is threadably engaged to the threads 32 on the outer surface of the neck 34 to close the bottle 22. When the bottle 22 is to be attached to the dipping container 24, the cap or lid is removed, and the opened neck 34 is threadably engaged to the dipping container 24 in the manner described below.

The dipping container 24 has a bottom plate 40 and an enclosing wall 42 that together define a dipping chamber 44. The plate 40 and wall 42 can define any shape or size. For example, the plate 40 and wall 42 can be configured so that the wall 42 is circular, oval, square, rectangular, polygonal, or any other irregular shape. The bottom plate 40 has a first opening 46 through which a supply tube 48 is extended, and a second opening 50 which communicates with a feedback channel 52. The first opening 46 can be positioned anywhere on the bottom plate 40.

The supply tube 48 can be made of rubber or injection-molded plastic. The supply tube 48 can be configured to have a first vertical section 54 that extends upwardly from its bottom end 55, a first horizontal section 56 having a first end that extends horizontally from the top of the first vertical section 54, a second vertical section 58 that extends upwardly for a short distance from the opposing second end of the first horizontal section 56, and a second horizontal section 60 having a first end that extends horizontally from the top of the second vertical section 58. The opposing second end 62 of the second horizontal section 60 is opened and communicates with the dipping chamber 44. The first horizontal section 56 can be positioned to lie on the top surface of the bottom plate 40. The supply tube 48 can be configured in the manner shown in FIGS. 2 and 3, and described herein, to optimize the delivery of the bubble solution 30 from the bottle 22 to the dipping chamber 44. Specifically, the second horizontal section 60 aligns its opened end in a horizontal direction so that the bubble solution 30 will be aimed at, and therefore delivered into, the dipping chamber 44. In other words, the various sections 54, 56, 58 and 60 serve to direct the flow of the bubble solution 30 into the dipping chamber 44. As an alternative, it is possible to configure the supply tube 48 with a single vertical section (e.g., with the vertical section 54 and omitting the other sections 56, 58, 60), but the user must be careful not to squeeze the bottle 22 too hard, otherwise the bubble solution 30 may be squirted vertically upwards, and not necessarily into the dipping chamber 44.

A conventional plastic tube 64 can have a first end 66 sleeved over the bottom end 55 of the supply tube 48, and an opposing second end 68 that is adapted to be positioned adjacent the bottom of the bottle 22. As an alternative, the tube 64 can be an extension of (e.g., made in one piece with) the first vertical section 54 of the supply tube 48.

A generally cylindrical connector 76 is provided on the bottom surface 78 of the bottom plate 40. In particular, the connector 76 has a generally cylindrical wall 80 having internal threads 82 that are adapted to threadably engage the external threads 32 on the neck 34 of a conventional bubble solution bottle 22. Depending on the size and shape of the bottom plate 40 and the wall 42 of the dipping container 24, the cylindrical wall 80 can be recessed inside, or extend beyond, the periphery of the bottom plate 40 and the wall 42. A short cylindrical feedback channel 52 is connected to the bottom surface 78 of the bottom plate 40 at the location of the second opening 50.

Figure 4:
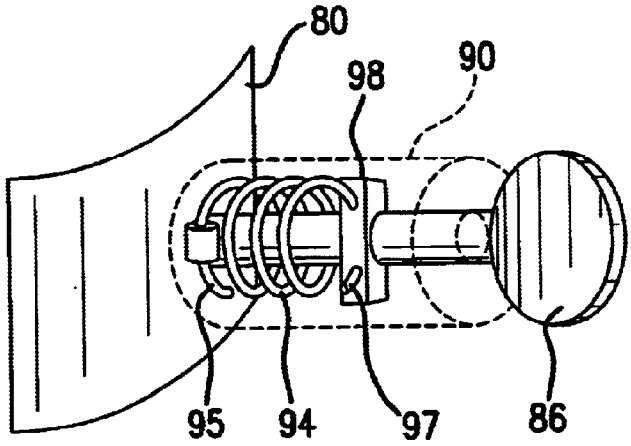
FIG. 4 is an enlarged sectional view of the release handle and spring of the dipping container of FIG. 1.

A release button 84 cooperates with the feedback channel 52 to open and close the feedback channel 52. In particular, the release button 84 has a handle 86 at a first end and a shaft 88 at a second opposing end. A spring housing 90 is provided at a location in the cylindrical wall 80 adjacent to the location of the feedback channel 52. A shaft channel 92 extends through the cylindrical wall 80 and an opening in the feedback channel 52, so as to connect the spring housing 90 with the feedback channel 52. A spring or other biasing element 94 is housed in the spring housing 90. The handle 86 of the release button 84 sits outside the spring housing 90. The shaft 88 of the release button 84 extends through the spring housing 90, the shaft channel 92 and into the feedback channel 52. Referring also to FIG. 4, the spring 94 has a first end 95 that is connected to the wall 80, and an opposing second end 97 that is connected to a protrusion 98 on the shaft 88. The configuration shown in FIG. 4 allows the spring 94 to bias the shaft 88 to block the feedback channel 52 (see FIG. 2) during normal operation. The bias of the spring 94 can be overcome by pulling the handle 86 of the release button 84 in a direction away from the wall 80. Pulling the handle 86 of the release button 84 in a direction away from the wall 80 will also cause the shaft 88 to retract from its blockage of the feedback channel 52, so that the force of gravity will cause the remaining bubble solution 96 in the dipping chamber 44 to flow via the feedback channel 52 into the bottle 22.

A tine suction element 100 is provided in the wall 80 of the connector 76. In particular, a support 102 is provided adjacent another opening 104 in the wall 80, and the suction element 100 is seated for reciprocating movement inside the support 102 and the wall 80. The reciprocating movement of the suction element 100 means that the bottom end 106 of the suction element 100 moves in and out of the opening 104, so that air from outside the bottle 22 can be vented into the interior 28 of the bottle 22 to make it easier to re-inflate and pressurize the bottle 22.

The dipping container 24 and the connector 76 can be made from any conventional leak-proof and sturdy injection-molded plastic material, including the plastic materials that are currently being used for conventional bubble solution dishes that are available in the market. Other possible materials for the dipping container 24 and the connector 76 include rubber, die-cast metal, cardboard, and non-porous paper materials.

In use, the user removes the cap or lid from a conventional bottle 22 of bubble solution, and threadably connects the neck 34 of the bottle 22 to the interior bore of the wall 80 via the interengaging threads 32 and 82. At this time, as best shown in FIG. 2, the first vertical section 54 of the supply tube 48 extends into the region of the neck 34, and the tube 64 extends into the bubble solution 30. The release button 84 is normally biased by the spring 94 so that its shaft 88 blocks the feedback channel 52. To fill the dipping chamber 44 with bubble solution 30, the user squeezes the wall 26 of the bottle 22, and the pressure generated by the squeeze will cause bubble solution 30 to be pumped or delivered via the tubes 64 and 48 into the dipping chamber 44. With the configuration shown in FIG. 2, the amount of bubble solution 96 in the dipping chamber 44 cannot exceed the height of the second horizontal section 60 of the supply tube 48 because the excess bubble solution will simply flow back into the bottle 22 via the supply tube 48. This feature ensures that the level of the bubble solution 96 in the dipping chamber 44 does not become too high, thereby minimizing the opportunity for spillage.

The user can then dip the bubble ring(s) of any bubble generating device or assembly into the dipping chamber 44 to generate a film of bubble solution across the ring(s). As the bubble solution 96 in the dipping chamber 44 is used up after repeated dippings, the user can squeeze the wall 26 of the bottle 22 to cause more bubble solution 30 from the bottle 22 to be delivered to the dipping chamber 44 to replenish the bubble solution 96. When the user has finished using the bubble solution 96, the user can pull the release button 84 in a direction away from the bottle 22, so that all the bubble solution 96 left in the dipping chamber 44 will flow back into the bottle 22.

Thus, the apparatus 20 of the present invention provides numerous benefits. First, bubble solution 30 can be delivered from a conventional bottle 22 to fill the dipping chamber 44 in a simple and effective manner in which spillage is minimized. Second, the volume of the bubble solution 96 in the dipping chamber 44 is regulated, again to minimize spillage. Third, any unused bubble solution 96 remaining in the dipping chamber 44 can be easily and quickly returned to the conventional bottle 22 with minimal spillage and waste.

Figure 5:
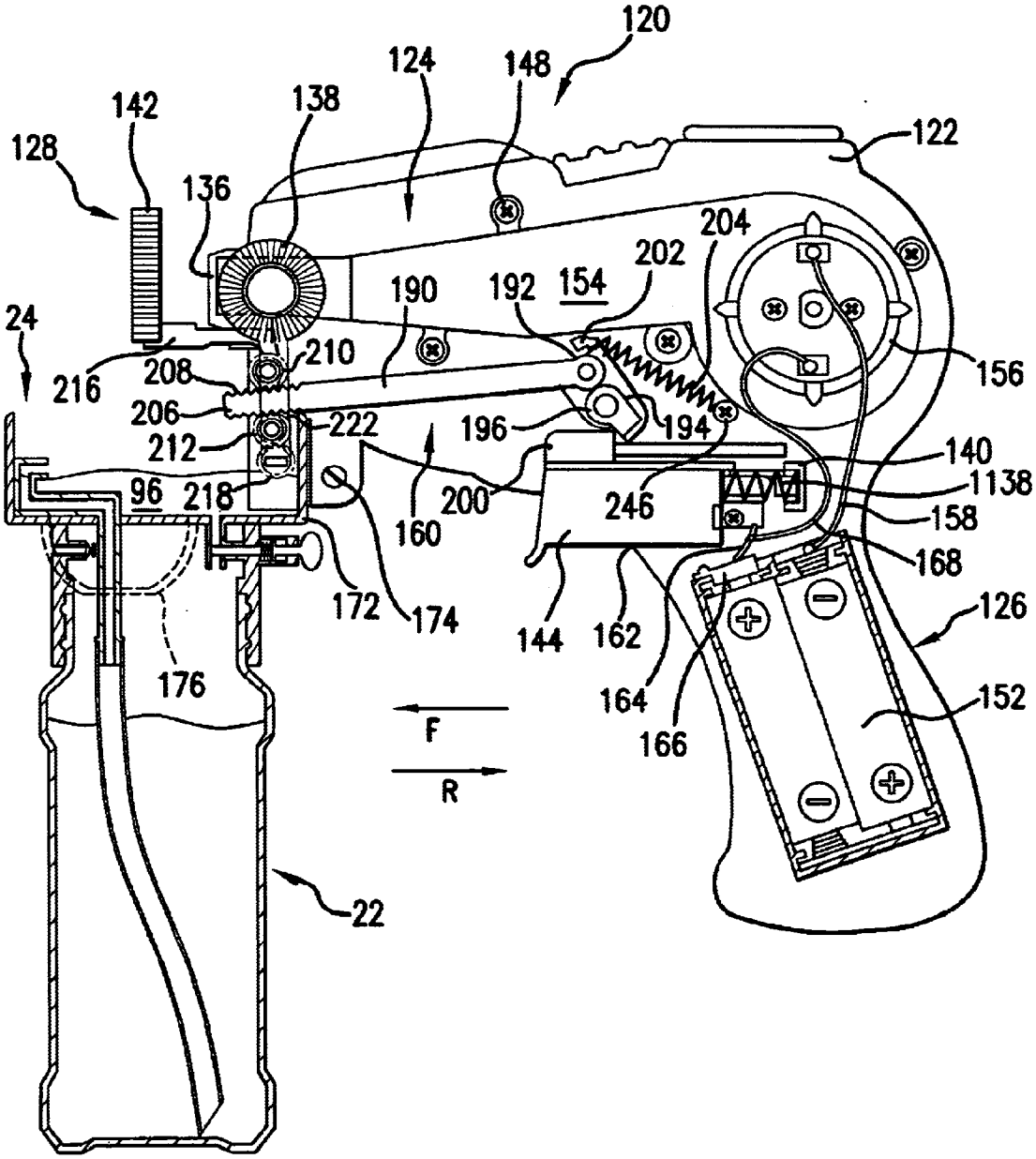
FIG. 5 is a cross-sectional side view of a bubble generating assembly that can incorporate the apparatus of FIG. 1.

The apparatus 20 in FIGS. 1–3 is well-suited for use with virtually any bubble generating device or assembly. The size and shape of the bottom plate 40 and the wall 42 can be adjusted to fit the sizes and shapes of the bubble ring(s) on any bubble generating device or assembly. Although the apparatus 20 is illustrated in FIGS. 1–3 as being used with a stand-alone dipping container 24, it is possible to incorporate the dipping container 24 into any bubble generating device or assembly. As a non-limiting example, FIG. 5 illustrates how the apparatus 20 can be incorporated with the bubble generating assembly that is shown and described in FIGS. 1–6 of U.S. Pat. No. 6,331,130 (Thai), whose entire disclosure is incorporated herein as though set forth fully herein.

Referring to FIG. 5, and to FIGS. 1–6 of U.S. Pat. No. 6,331,130 (Thai), the assembly 120 can be embodied in the form of a bubble producing gun, and has a housing 122 that includes a barrel section 124 and a handle section 126. A bubble producing device 128 and the apparatus 20 are provided at the front end of the barrel section 124 adjacent the nozzles of the barrel section 124. There are three nozzles that are positioned so that two side nozzles (not shown) open to opposing sides of the assembly 120, and one front nozzle 136 opens towards the front of the assembly 120 so that the front nozzle 136 is generally perpendicular to the side nozzles. The bubble producing device 128 has three separate bubble rings that include two side rings 138 and a front ring 142. Each ring 138, 142 is operatively coupled (as described hereinbelow) to the barrel section 124 and can be raised from a rest or non-use position inside the dipping container 24 to a bubble generating position adjacent a corresponding nozzle.

A trigger 144 is operatively coupled to the barrel section 124 and the handle 126 to actuate the assembly 120. A spring 138 has a rear end that is seated on a shaft of the trigger 144 in a slot 140 in the handle section 126, and has an opposing front end that abuts the rear end of the trigger 144 to naturally bias the trigger 144 in a forward direction (see arrow F) towards the nozzles 136. In particular, when the assembly 120 is a non-use position, the assembly 120 can be actuated by pressing the trigger 144 to simultaneously (1) raise the rings 138, 142 to a bubble generating position and (2) cause air to be blown through the nozzles 136 and through the rings 138,142 to produce three separate streams of bubbles. This simultaneous action is illustrated in FIG. 5 in the bubble-generating position.

The housing 122 can be provided in the form of two symmetrical outer shells that are connected together by, for example, screws 148 or by welding or glue. These outer shells together define a hollow interior for housing the internal components of the assembly 120, as described below.

The handle section 126 houses a power source 152 which can include two conventional batteries. The barrel 124 houses an air generator or blower 154 that is driven by a motor 156 that is electrically coupled to the power source 152 via a wire 158. The barrel 124 also houses a link assembly 160 that functions to raise and lower the rings 138, 142. The trigger 144 extends through an opening 162 in the housing 122 and is mechanically coupled to the link assembly 160, and electrically coupled to both the power source 152 (by opposing electrical conductors 164 and 166) and the motor 156 (by wiring 168).

The dipping container 24 can have a four-sided configuration that is similar to the solution container shown in U.S. Pat. No. 6,331,130 (Thai), with one side 172 connected to the front of the barrel section 124 by either welding, screws (e.g., 174), or the like. The dipping container 24 can be further modified for use with the bubble generating assembly 120 in FIG. 4 by providing two narrow semi-circular troughs 176 extending from the bottom plate 40 of the dipping container 24. Each trough 176 can be the same as the troughs described in U.S. Pat. No. 6,331,130, and is adapted to receive a portion of a side ring 138 in the non-use position, so that the entire circumference of each side ring 138 can be immersed in the bubble solution 96 that collects inside the troughs 176.

The link assembly 160 operates to mechanically couple the trigger 144 to the rings 138, 142 to control the raising and lowering of the rings 138, 142. The link assembly 160 has a rod 190 having an enlarged and rounded first end 192 that operates as a cam surface. The first end 192 is pivotably coupled to a block 194 (i.e., coupled to allow first end 192 and block 194 to pivot separately). A generally rounded cam piece 196 is permanently coupled to the block 194 (i.e., coupled so that cam piece 196 and block 194 cannot pivot'separately). The first end 192 and the cam piece 196 are disposed in a manner in which the circumferential surface of the cam piece 196 rotatably engages the circumferential surface of the first end 192. The cam piece 196 has a straight engaging surface that is adapted to be engaged by a block 200 provided on the trigger 144. The block 194 has a hooked extension 202 on which one end of a spring 204 is coupled. The other end of the spring 204 is secured to the housing 122 (e.g., by screw 246).

The rod 190 has a serrated second end 206 having a plurality of teeth 208 on its top and bottom sides that are adapted to engage a gearing system that operates to raise and lower the rings 138, 142. The gearing system includes gears that are coupled to each of the rings 138, 142. For example, a pair of opposing first and second gears 210 and 212 have teeth that are engaged to travel along the teeth 108 of the opposing top and bottom sides of the rod 190. The gear 210 is housed inside the housing 122, and is connected to one end of a generally L-shaped rod 216 which extends outside the housing 122 and whose opposite end is connected to the front ring 142 in a manner such that the rod 216 is generally perpendicular to the front ring 142. A third gear 218 has teeth that are adapted to engage the teeth of the second gear 212. The third gear 218 is also housed inside the housing 122. The first and second gears 210, 212 can be provided in the form of two toothed wheels, while the third gear 218 can be an elongated circular rod having teeth provided on its outer annular surface. The elongated nature of the third gear 218 allows each of its opposing ends to be connected to one end of a separate rod 222 which extends outside the housing 122 and whose opposite end is connected to one of the side rings 138. Each rod 222 is generally parallel to or co-planar with its corresponding side ring 138. Thus, the third gear 218 alone can be used to control the two side rings 138.

Each ring 138, 142 can have the same structure, and in one non-limiting embodiment, can be a ring-like loop that has an opening, and with ridges or bumps provided on the outer surfaces of the rings. The ridges function to hold the bubble solution against the ring to form a solution film that is blown to form the bubble. The front ring 142 can be larger than the two side rings 138.

The operation of the assembly 120 is described as follows. First, the dipping container 24 is filled with bubble solution 96 using the method described above. At this time, the rings 138, 142 are positioned inside the dipping container 24, and preferably completely inside the bubble solution 96. The side rings 138 are positioned perpendicular to the front ring 142, with the side rings 138 being generally vertical with respect to the orientation of the assembly 120 and partially positioned inside the troughs 176, and with the front ring 142 being generally horizontal with respect to the orientation of the assembly 120 and positioned between the side rings 138.

In the next step, the user presses the trigger 144 to cause the trigger 144 to move rearwardly in the direction of arrow R. The electrical conductor 164 on the trigger 144 will engage the electrical conductor 166 of the power source 152, causing the motor 156 to be powered to generate bursts of air that are then emitted from the blower 154 through the three nozzles. Simultaneously, the block 200 positioned on the top of the trigger 144 engages the straight engaging surface of the cam piece 196, and pushes the cam piece 196 rearwardly in the direction of arrow R. This causes the block 194 and the first end 192 to be pivoted about their pivot point, which in turn causes the lower part of the block 194 (where the cam piece 196 is positioned) to be moved rearwardly, and the upper part of the block 194 (where the first end 192 is positioned) to be moved forwardly in the direction of arrow F. The forward motion of the first end 192 will stretch the spring 204 to build up a spring load, and will cause the entire rod 190 to be moved forwardly, causing the serrated front end 206 to pass between the gears 210 and 212. The teeth 208 on the rod 190 will engage the teeth of the gears 210, 212 and will travel thereon, causing the first gear 210 to rotate in the clockwise direction (as seen in the orientation of FIG. 5), and the second gear 212 to rotate in the counter-clockwise direction, thereby causing the front ring 142 to be raised. The counter-clockwise rotation of the second gear 212 will simultaneously cause the third gear 218 to rotate in a clockwise manner thereby causing the side rings 138 to be raised. Thus, the three rings 138, 142 are raised at about the same time, and when raised, each will be adjacent a nozzle. Therefore, the air that is blown from the blower 154 through the nozzles will pass through the rings 138, 142, producing three separate streams of bubbles.

After the three streams of bubbles have been produced, and upon relaxing the force applied to the trigger 144, two events will occur simultaneously: (1) the spring 138 coupled to the rear of the trigger 44 will bias the trigger 144 forwardly in the direction of arrow F so as to disengage the contact between the electrical conductors 164 and 166, cutting power to the motor 156, and (2) the built-up spring load of the spring 204 will bias the upper part of the block 194 rearwardly, pulling the rod 190 rearwardly in the direction of arrow R and causing the gears 210, 212, 218 to rotate in directions opposite to those described above (i.e., counter-clockwise for gears 210, 218, and clockwise for gear 212) to lower the wands 138, 142 back into their non-use positions inside the dipping container 24. At this time, the assembly 120 is again ready to produce bubbles upon the pressing of the trigger 144.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A bubble containing apparatus, comprising:

a container having a bottom and a wall that define a chamber;

a bottle having an interior that contains bubble solution;

means for coupling the bottle to the container;

means for delivering the bubble solution from the interior of the bottle to the chamber of the container;

a feedback channel that fluidly couples the chamber and the interior of the bottl;e and means for releasably blocking the feedback channel.

2. The apparatus of claim 1, wherein the delivering means includes a supply tube having a first end that is positioned in the interior of the bottle and an opposing second end that is positioned inside the chamber.

3. The apparatus of claim 2, wherein the supply tube comprises a straight vertical section.

4. The apparatus of claim 1, wherein the bottle has an opened neck having external threads, and wherein the coupling means includes:

a generally cylindrical connector provided below the bottom of the container, and having internal threads that releasably engage the external threads of the bottle.

5. A bubble containing apparatus, comprising:

a container having a bottom and a wall that define a chamber;

a bottle having an interior that contains bubble solution;

means for coupling the bottle to the container; and a supply tube having a first end that is positioned in the interior of the bottle and an opposing second end that is positioned inside the chamber for delivering the bubble solution from the interior of the bottle to the chamber of the container;

wherein the supply tube has a first vertical section, a first horizontal section that extends horizontally from the first vertical section, a second vertical section that extends upwardly from the first horizontal section, and a second horizontal section that extends horizontally from the second vertical section, with the second horizontal section having an open end that communicates with the chamber.

6. A bubble containing apparatus, comprising:

a container having a bottom and a wall that define a chamber;

a bottle having an interior that contains bubble solution;

means for coupling the bottle to the container;

means for delivering the bubble solution from the interior of the bottle to the chamber of the container; and means for venting the interior of the bottle.

7. A bubble container, comprising:

a bottom plate having an opening;

an enclosing wall that defines a chamber that retains bubble solution;

a connector provided adjacent the bottom plate for releasably connecting a bottle;

a supply tube that extends through the opening into the chamber;

a feedback channel that is coupled to the bottom plate; and means for releasably blocking the feedback channel.

8. The apparatus of claim 7, wherein the supply tube comprises a straight vertical section.

9. The apparatus of claim 7, wherein the enclosing wall has a plurality of internal threads.

10. The apparatus of claim 7, wherein the supply tube has a first end that is positioned in the interior of a separate bottle and an opposing second end that is positioned inside the chamber.

11. A bubble container, comprising:

a bottom plate having an opening;

an enclosing wall that defines a chamber that retains bubble solution;

a connector provided adjacent the bottom plate for releasably connecting a bottle; and a supply tube that extends through the opening into the chamber;

wherein the supply tube has a first vertical section, a first horizontal section that extends horizontally from the first vertical section, a second vertical section that extends upwardly from the first horizontal section, and a second horizontal section that extends horizontally from the second vertical section, with the second horizontal section having an open end that communicates with the chamber.

12. A bubble container, comprising:

a bottom plate having an opening;

an enclosing wall that defines a chamber that retains bubble solution;

a connector provided adjacent the bottom plate for releasably connecting a bottle;

a supply tube that extends through the opening into the chamber; and a vent mechanism provided on the enclosing wall.

13. A bubble generating assembly, comprising:

a housing;

an air generator;

at least one bubble producing device positioned in front of the air generator to receive air generated from the air generator;

a link having a first end coupled to the at least one bubble producing devices;

an actuator operatively coupled to the link assembly and the air generator for simultaneously actuating the air generator and causing the link to position the at least one bubble producing devices in front of the air generator to receive air generated from the air generator; and a bubble solution dipping apparatus coupled to the housing, the dipping apparatus including:

a container having a bottom and a wall that define a chamber;

a bottle having an interior that contains bubble solution;

means for coupling the bottle to the container; and means for delivering the bubble solution from the interior of the bottle to the chamber of the container.

14. The assembly of claim 13, further including a gear system operatively coupling the first end of the link and the at least one bubble producing device.

15. A bubble generating assembly, comprising:

a housing;

an air generator;

at least one bubble producing device positioned in front of the air generator to receive air generated from the air generator;

a bubble, solution dipping apparatus coupled to the housing, the dipping apparatus including:

a container having a bottom and a wall that define a chamber;

a bottle having an interior that contains bubble solution;

means for coupling the bottle to the container; and means for delivering the bubble solution from the interior of the bottle to the chamber of the container;

wherein the at least one bubble producing device includes a plurality of bubble rings.

16. A method of delivering bubble solution to a bubble solution dipping container, comprising:

providing a bubble solution dipping container having a bottom and a wall that define a chamber;

providing a bottle having a wall that defines an interior that contains bubble solution;

releasably coupling the bottle to the container;

providing a fluid connection between the interior of the bottle and the chamber of the dipping container;

applying pressure to the wall of the bottle to deliver the bubble solution from the interior of the bottle to the chamber of the container;

providing a feedback channel that fluidly connects the chamber and the interior of the bottle; and opening the feedback channel to allow bubble solution from the chamber to flow back into the interior of the bottle.

* * * * *